United States Patent [19]

Quin

[11] Patent Number: 4,505,767

[45] Date of Patent: Mar. 19, 1985

[54] NICKEL/TITANIUM/VANADIUM SHAPE MEMORY ALLOY

[75] Inventor: Mary P. Quin, Redwood City, Calif.

[73] Assignee: Raychem Corporation, Menlo Park, Calif.

[21] Appl. No.: 541,844

[22] Filed: Oct. 14, 1983

[51] Int. Cl.[3] ..... C22C 19/00; C22C 30/00

[52] U.S. Cl. ..... 148/402; 148/442; 420/441

[58] Field of Search ..... 148/402, 11.5 F, 11.5 N; 420/442, 441

[56] References Cited

U.S. PATENT DOCUMENTS

| | | | |
|---|---|---|---|
| 3,174,851 | 3/1965 | Buehler et al. | 148/426 |
| 3,351,463 | 11/1967 | Rozner et al. | 148/426 |
| 3,558,369 | 1/1971 | Wang et al. | 148/11.5 N |
| 3,620,212 | 11/1971 | Fannon et al. | 128/130 |
| 3,740,839 | 6/1973 | Otte et al. | 29/628 |
| 3,753,700 | 8/1973 | Harrison et al. | 148/402 |
| 3,786,806 | 1/1974 | Johnson et al. | 128/92 D |
| 3,832,243 | 8/1974 | Donkersloot et al. | 148/402 |
| 3,890,977 | 6/1975 | Wilson | 128/418 |
| 4,019,925 | 4/1977 | Nenno et al. | 148/402 |
| 4,035,007 | 7/1977 | Harrison | 285/381 |
| 4,144,057 | 3/1979 | Melton et al. | 148/11.5 N |
| 4,198,081 | 4/1980 | Harrison | 285/381 |
| 4,205,293 | 5/1980 | Melton et al. | 337/140 |
| 4,310,354 | 1/1982 | Fountain et al. | 75/211 |

FOREIGN PATENT DOCUMENTS

| | | | |
|---|---|---|---|
| 63655 | 4/1982 | Japan | 148/402 |

OTHER PUBLICATIONS

Alloys Index, vol. 8, 1981, p. E-758, "Ti48Ni43V9".
Alloys Index, vol. 9, 1982, p. E-871, "48Ti-43Ni-9V".
U.S. Patent Application Ser. No. 541,852, Applicant: James Jarvis.
Buehler et al., (Mater. Des. Eng., pp. 82-83, (Feb. 1962)).
Wang et al., J. App. Phys., V. 36, pp. 3232-3239, (1965).
Wasilewski et al., Met. Trans., v. 2, pp. 229-238, (1971).
U.S. Naval Ordinance Laboratory Report NOLTR 64-235, (Aug. 1965).
Honma et al., Res. Inst. Min. Dress. Met. Report No. 622, (1972).
Kovneristii et al., Proc. 4th Int. Conf. on Titanium, v. 2, pp. 1469-1479.

*Primary Examiner*—Peter K. Skiff
*Attorney, Agent, or Firm*—Ira D. Blecker; James W. Peterson; Herbert G. Burkard

[57] ABSTRACT

Nickel/titanium alloys having a nickel:titanium atomic ratio between about 1:02 and 1:13 and a vanadium content between about 4.6 and 25.0 atomic percent show constant stress versus strain behavior due to stress-induced martensite in the range from about 0° to 60° C.

8 Claims, 6 Drawing Figures

NICKEL/TITANIUM/VANADIUM SHAPE MEMORY ALLOY

BACKGROUND OF THE INVENTION

Field of the Invention

This invention relates to nickel/titanium shape memory alloys and improvements therein.

Introduction to the Invention

Materials, both organic and metallic, capable of possessing shape memory are well known. An article made of such materials can be deformed from an original, heat-stable configuration to a second, heat-unstable configuration. The article is said to have shape memory for the reason that, upon the application of heat along, it can be caused to revert, or to attempt to revert, from its heat-unstable configuration to its original, heat-stable configuration, i.e. it "remembers" its original shape.

Among metallic alloys, the ability to possess shape memory is a result of the fact that the alloy undergoes a reversible transformation from an austenitic state to a martensitic state with a change in temperature. This transformation is sometimes referred to as a thermoelastic martensitic transformation. An article made from such an alloy, for example a hollow sleeve, is easily deformed from its original configuration to a new configuration when cooled below the temperature at which the alloy is transformed from the austenitic state to the martensitic state. The temperature at which this transformation begins is usually referred to as $M_s$ and the temperature at which it finishes $M_f$. When an article thus deformed is warmed to the temperature at which the alloy starts to revert back to austenite, referred to as $A_s$ ($A_f$ being the temperature at which the reversion is complete) the deformed object will begin to return to its original configuration.

Shape memory alloys (SMAs) have found use in recent years in, for example, pipe couplings (such as are described in U.S. Pat. Nos. 4,035,007 and 4,198,081 to Harrison and Jervis), electrical connectors (such as are described in U.S. Pat. No. 3,740,839 to Otte and Fischer), switches (such as are described in U.S. Pat. No. 4,205,293), actuators, etc.

Various proposals have also been made to employ shape memory alloys in the medical field. For example, U.S. Pat. No. 3,620,212 to Fannon et al. proposes the use of an SMA intrauterine contraceptive device, U.S. Pat. No. 3,786,806 to Johnson et al. proposes the use of an SMA bone plate, U.S. Pat. No. 3,890,977 to Wilson proposes the use of an SMA element to bend a catheter or cannula, etc.

These medical SMA devices rely on the property of shape memory to achieve their desired effects. That is to say, they rely on the fact that when an SMA element is cooled to its martensitic state and is subsequently deformed, it will retain its new shape; but when it is warmed to its austenitic state, the original shape will be recovered.

However, the use of the shape memory effect in medical applications is attended with two principal disadvantages. First, it is difficult to control the transformation temperatures of shape memory alloys with accuracy as they are usually extremely composition-sensitive, although various techniques have been proposed (including the blending by powder metallurgy of already-made alloys of differing transformation temperatures: see U.S. Pat. No. 4,310,354 to Fountain et al.).

Second, in many shape memory alloys there is a large hysteresis as the alloy is transformed between austenitic and martensitic states, so that reversing of the state of an SMA element may require a temperature excursion of several tens of degrees Celsius. The combination of these factors with the limitation that human tissue cannot be heated or cooled beyond certain relatively narrow limits without suffering temporary or permanent damage is expected to limit the use that can be made of SMA medical devices.

In copending and commonly assigned U.S. patent application (Ser. No. 541,844, filed 10/14/83) to Jervis, the disclosure of which is incorporated herein by reference, it is proposed that the stress-induced martensite (SIM) properties of shape memory alloys be employed in SMA medical devices, rather than the use of the shape memory effect.

When an SMA sample exhibiting stress-induced martensite is stressed at a temperature above $M_s$ (so that the austenitic state is initially stable), it first deforms elastically and then, at a critical stress, begins to transform by the formation of stress-induced martensite. Depending on whether the temperature is above or below $A_s$, the behavior when the deforming stress is released differs. If the temperature is below $A_s$, the stress-induced martensite is stable; but if the temperature is above $A_s$, the martensite is unstable and transforms back to austenite, with the sample returning (or attempting to return) to its original shape. The effect is seen in almost all alloys which exhibit a thermoelastic martensitic transformation, along with the shape memory effect. However, the extent of the temperature range over which SIM is seen and the stress and strain ranges for the effect vary greatly with the alloy. For many purposes, it is desirable that the SIM transformation occur at a relatively constant stress over a wide strain range, thereby enabling the creation of, in effect, a constant force spring.

Various alloys of nickel and titanium have in the past been disclosed as being capable of having the property of shape memory imparted thereto. Examples of such alloys may be found in U.S. Pat. Nos. 3,174,851 and 3,351,463.

Buehler et al (Mater. Des. Eng., pp.82–3 (Feb. 1962); J. App. Phys., v.36, pp.3232–9 (1965)) have shown that in the binary Ni/Ti alloys the transformation temperature decreases dramatically and the yield strength increases with a decrease in titanium content from the stoichiometric (50 atomic percent) value. However, lowering the titanium content below 49.9 atomic percent has been found to produce alloys which are unstable in the temperature range of 100° C. to 500° C., as described by Wasilewski et al., Met. Trans., v.2, pp. 229–38 (1971). The instability (temper instability) manifests itself as a change (generally an increase) in $M_s$ between the annealed alloy and the same alloy which has been further tempered. Annealing here means heating to a sufficiently high temperature and holding at that temperature long enough to give a uniform, stress-free condition, followed by sufficiently rapid cooling to maintain that condition. Temperatures around 900° C. for about 10 minutes are generally sufficient for annealing, and air cooling is generally sufficiently rapid, though quenching in water is necessary for some of the low Ti compositions. Tempering here means holding at an intermediate temperature for a suitably long period (such as a few hours at 200°–400° C.). The instability thus makes the low titanium alloys disadvantageous for shape memory applications, where a combination of high yield strength and reproducible $M_s$ is desired.

Although certain cold-worked binary nickel/-titanium alloys have been shown to exhibit SIM, these alloys are difficult to use in practice because, in order to obtain the appropriate $M_s$ to give SIM properties at physiologically acceptable temperatures, the alloys must have less than the stoichiometric titanium content. These binary alloys then are (1) extremely composition-sensitive in $M_s$, as referred to above for shape memory; (2) unstable in $M_s$ with aging and sensitive to cooling rate; and (3) require cold-working to develop the SIM, so that any inadvertent plastic deformation is not recoverable simply by heat-treatment: new cold-working is required.

Certain ternary Ni/Ti alloys have been found to overcome some of these problems. An alloy comprising 47.2 atomic percent nickel, 49.6 percent titanium, and 3.2 atomic percent iron (such as disclosed in U.S. Pat. No. 3,753,700 to Harrison et al.) has an $M_s$ temperature near −100° C. and a yield strength of about 70,000 psi. While the addition of iron has enabled the production of alloys with both low $M_s$ temperature and high yield strength, this addition has not solved the problem of instability, nor has it produced a great improvement in the sensitivity of the $M_s$ temperature to compositional change.

U.S. Pat. No. 3,558,369 shows that the $M_s$ temperature can be lowered by substituting cobalt for nickel, then iron for cobalt in the stoichiometric alloy. However, although the alloys of this patent can have low transformation temperatures, they have only modest yield strengths (40,000 psi or less).

U.S. Naval Ordnance Laboratory Report NOLTR 64-235 (August 1965) examined the effect upon hardness of ternary additions of from 0.08 to 16 weight percent of eleven different elements, including vanadium, to stoichiometric Ni/Ti. Similar studies have been made by, for example, Honma et al., Res. Inst. Min. Dress. Met. Report No. 622 (1972) and Proc. Int. Conf. Martensitic Transformations (ICOMAT '79), pp. 259–264; Kovneristii et al., Proc. 4th Int. Conf. on Titanium, v. 2, pp. 1469–79 (1980); and Donkersloot et al., U.S. Pat. No. 3,832,243, on the variation of transformation temperature with ternary additions, also including vanadium. These references, however, do not describe any SIM behavior in the alloys studied.

It would thus be desirable to develop an alloy which exhibits stress-induced martensite in the range from 0° to 60° C. which is preferably of low composition sensitivity for ease of manufacture.

DESCRIPTION OF THE INVENTION

Summary of the Invention

I have discovered that the addition of appropriate amounts of vanadium to nickel/titanium shape memory alloys permits the production of workable alloys exhibiting stress-induced martensite in a physiologically acceptable temperature range, when in the fully annealed condition (i.e. no cold working is required to produce the desired mechanical properties).

This invention thus provides a shape memory alloy consisting essentially of nickel, titanium, and vanadium within an area defined on a nickel, titanium, and vanadium ternary composition diagram by a hexagon with its first vertex at 38.0 atomic percent nickel, 37.0 atomic percent titanium, and 25.0 atomic percent vanadium; its second vertex at 47.6 atomic percent nickel, 46.4 atomic percent titanium, and 6.0 atomic percent vanadium; its third vertex at 49.0 atomic percent nickel, 46.4 atomic percent titanium, and 4.6 atomic percent vanadium; its fourth vertex at 49.8 atomic percent nickel, 45.6 atomic percent titanium, and 4.6 atomic percent vanadium; its fifth vertex at 49.8 atomic percent nickel, 44.0 atomic percent titanium, and 6.2 atomic percent vanadium; and its sixth vertex at 39.8 atomic percent nickel, 35.2 atomic percent titanium, and 25.0 atomic percent vanadium.

DETAILED DESCRIPTION OF THE PREFERRED EMBODIMENTS

FIGS. 1A through 1E are typical stress-strain curves for shape memory alloys at various temperatures. Ignoring, for the moment, the difference between $M_s$ and $M_f$, and between $A_s$ and $A_f$, the behavior of a shape memory alloy may be generally seen to fit with one of these Figures.

Figure 1A:
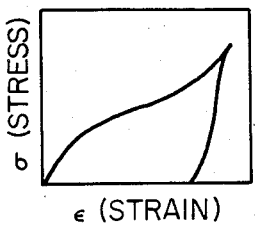
FIGS. 1A through 1E are typical stress-strain curves for shape memory alloys at various temperatures.

In FIG. 1A, T is below $M_s$. The alloy is initially martensitic, and deforms by twinning beyond a low elastic limit. This deformation, though not recoverable at the deformation temperature, is recoverable when the temperature is increased above $A_s$. This gives rise to the conventional shape memory effect.

Figure 1B:
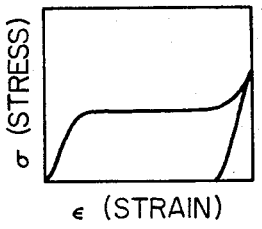

In FIG. 1B, T is between $M_s$ and $M_d$ (the maximum temperature at which martensite may be stress-induced), and below $A_s$. Here, though the alloy is initially austenitic, stress results in the formation of martensite permitting ready deformation. Because the alloy is below $A_s$, the deformation is again not recoverable until heating to above $A_s$ results in the transformation back to austenite If the sample is unrestrained, the original shape will be completely recovered: if not, it will be recovered to the extent permitted by the restraint. However, if the material is then allowed to re-cool to the temperature of deformation, the stress produced in the alloy is constant regardless of the strain provided that the strain lies within the "plateau" region of the stress-strain curve. This means that a known, constant force (calculable from the height of the stress plateau) can be applied over a wide (up to 5% or more) strain range.

Figure 1C:
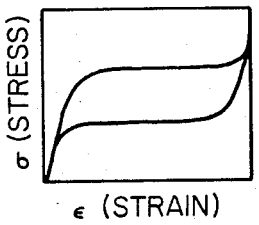

In FIG. 1C, T is between $M_s$ and $M_d$, and above $A_s$. Here, the stress-induced martensite is thermally unstable and reverts to austenite as the stress is removed. This produces, without heating, what is, in effect, a constant-force spring acting over a strain range which can be about 5%. This behavior has been termed stress-induced martensite pseudoelasticity.

Figure 1D:
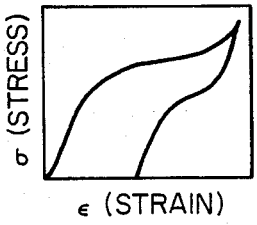

FIG. 1D shows the situation where T is near $M_d$. Although some stress-induced martensite is formed, the stress level for martensite formation is close to the austenitic yield stress of the alloy and both plastic and SIM deformation occur. Only the SIM component of the deformation is recoverable.

Figure 1E:
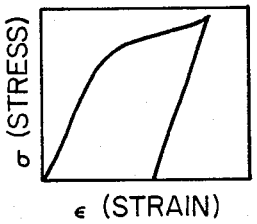

FIG. 1E shows T above $M_d$. The always-austenitic alloy simply yields plastically when stressed beyond its elastic yield point and the deformation is non-recoverable.

The type of stress-strain behavior shown in these FIGS. 1A through 1E will hereafter be referred to as A- through E-type behavior.

Constant stress over a wide strain range is desirable mechanical behavior for many medical applications. Such a plateau in the stress-strain curve of these alloys occurs over limited temperature ranges above $M_s$ and below $M_d$.

Such properties are useful for medical products when they occur at temperatures between 0° C. and 60° C., and particularly at 20° C. to 40° C. It has been discovered that certain compositions of Ni/Ti/V alloys exhibit B- or C-style behavior in this temperature range.

Shape memory alloys according to the invention may conveniently be produced by the methods described in, for example, U.S. Pat. Nos. 3,753,700 and 4,144,057. The following example illustrates the method of preparation and testing of samples of shape memory alloys.

EXAMPLE

Commercially pure titanium and vanadium and carbonyl nickel were weighed in proportions to give the atomic percentage compositions listed in Table I (the total mass for test ingots was about 330 g). These metals were placed in a water-cooled copper hearth in the chamber of an electron beam melting furnace. The chamber was evacuated to $10^{-5}$ Torr and the charges were melted and alloyed by use of the electron beam. The resulting ingots were hot swaged and hot rolled in air at approximately 850° C. to produce strip of approximately 0.025 inch thickness. Samples were cut from the strip, descaled, vacuum annealed at 850° C. for 30 minutes, and furnace cooled.

The transformation temperature of each alloy was determined (on an annealed sample) as the temperature at the onset of the martensite transformation at 10 ksi stress, referred to as $M_s$ (10 ksi).

For a series of samples, stress-strain curves were measured at temperatures between −10° and 60° C. to determine the existence of stress-induced martensite behavior.

TABLE I

| Properties of Nickel/Titanium/Vanadium Alloys | | | | | | | | | | | | |
|---|---|---|---|---|---|---|---|---|---|---|---|---|
| Composition Atomic Percent | | | $M_s$(10ksi) | Mechanical Behavior(° C.) | | | | | | | | |
| Ni | Ti | V | °C. | −10° | 0° | 10° | 20° | 30° | 40° | 50° | 60° |
| 51.0 | 45.5 | 3.5 | <−196 | | | | | | | | |
| 48.5 | 41.5 | 10.0 | <−196 | | | | | | | | |
| 49.5 | 43.5 | 7.0 | −107 | | | | | | | | |
| 50.0 | 44.0 | 6.0 | −96 | | | | | | | | |
| 49.0 | 43.0 | 8.0 | −83 | | | | | | | | |
| 50.0 | 45.0 | 5.0 | −42 | | D | | D | | | | |
| 49.0 | 45.0 | 6.0 | −35 | | C | | C | | C/D | | D |
| 50.5 | 48.0 | 1.5 | −32* | | B | | D | | E | | |
| 45.0 | 41.0 | 14.0 | −32 | | | | | | C/D | | |
| 48.5 | 44.5 | 7.0 | −30 | | C | | C | | C/D | | |
| 49.5 | 45.5 | 5.0 | −13 | B | C | | C | | | D | |
| 50.0 | 46.0 | 4.0 | −11* | | B | | D | | D | | |
| 48.5 | 45.0 | 6.5 | −10 | B | | B | | C | | D | |
| 49.0 | 45.5 | 5.5 | −10 | B | | B | | C | | C/D | |
| 48.0 | 44.25 | 7.75 | −7 | | A/B | | C | | C/D | | |
| 48.5 | 45.5 | 6.0 | −5 | A | B | | B | | C | | |
| 41.5 | 38.5 | 20.0 | −2 | A | A | | B | | B | | B/C |
| 46.5 | 43.5 | 10.0 | −1 | | A | | B | | C | | |
| 36.25 | 33.75 | 30.0 | 0* | | A | | A | | B | | B |
| 49.5 | 46.0 | 4.5 | 6* | | B | | B | | D | | |
| 48.0 | 46.0 | 6.0 | 12 | A | A/B | B | B | B | B | B | D |
| 47.75 | 45.75 | 6.5 | 20 | | A | | A | | B | | B |
| 47.5 | 45.5 | 7.0 | 26 | | A | | A | | B | | B |
| 48.5 | 46.5 | 5.0 | 27 | | A | | A | | B | | B |
| 45.0 | 45.0 | 10.0 | 30 | | | | A | A/B | B | | B |
| 47.5 | 46.5 | 6.0 | 32 | | | | A | B | B | B | B |
| 46.5 | 46.5 | 7.0 | 34 | | A | | A | | B | | |
| 48.25 | 46.25 | 5.5 | 36 | | A | | A | | B | | B |

*Alloys with an asterisk beside the $M_s$ temperature are not within the scope of the invention, even though the $M_s$ temperature is in the correct range.

It can be seen from Table I that alloys with an $M_s$ higher than −40° C. but lower than 20° C. show predominantly B- and C-type behavior at 20° and 40° C. This $M_s$ criterion is not sufficient to ensure a flat stress-strain curve at the desired temperatures, however. A vanadium content of at least 4.6 atomic percent is also necessary, since alloys with 1.5 and 4.0 atomic percent V show D- and E-type behavior at 20° C. and 40° C. The sample with a V content of 4.5 at % shows D-type behavior at 40° C., although B-type at 0° and 20° C. Such an alloy would be marginally useful.

Since the alloy with an $M_s$ of −42° C. has D-type behavior at 0° C., it is expected that alloys with an $M_s$ below −40° C. will show D- or E-type behavior in the temperature range of interest, while alloys with an $M_s$ above 20° C. show A-type behavior over at least half the 0°-60° C. range.

Too much vanadium also leads to undesirable properties, since an alloy with 30 atomic percent vanadium shows a lesser degree of SIM elongation and a much higher yield strength for the SIM transformation than alloys of lower vanadium content. This alloy also showed A-type behavior at 20° C. despite an $M_s$ of −3° C. Such an alloy, with a nearly 1:1:1 composition ratio, is probably not treatable as a Ni/Ti type alloy.

Figure 2:
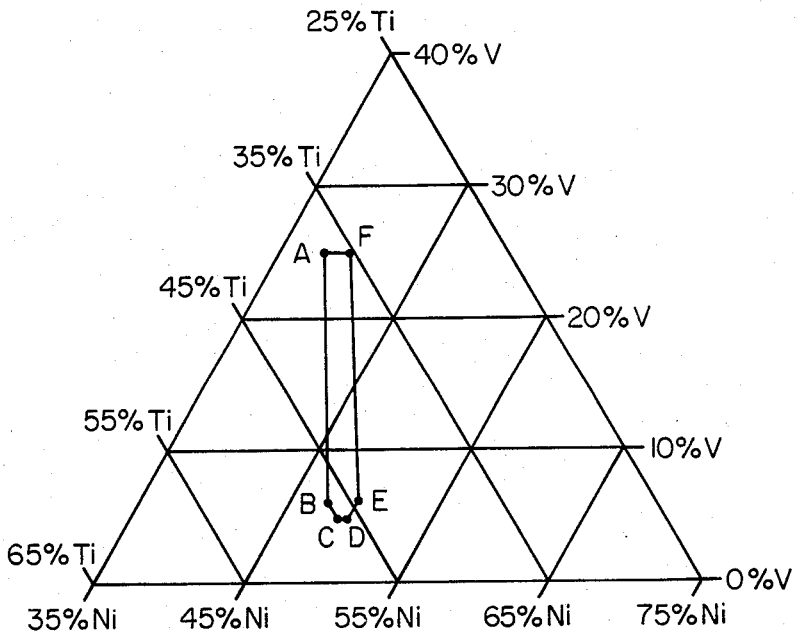
FIG. 2 is a nickel/titanium/vanadium ternary composition diagram showing the area of the alloy of this invention.

The claimed composition range, based on these data, is shown in FIG. 2, and the compositions at the vertices given in Table II.

TABLE II

| Atomic Percent Compositions | | | |
|---|---|---|---|
| Point | Nickel | Titanium | Vanadium |
| A | 38.0 | 37.0 | 25.0 |

TABLE II-continued

| Point | Atomic Percent Compositions | | |
|---|---|---|---|
| | Nickel | Titanium | Vanadium |
| B | 47.6 | 46.4 | 6.0 |
| C | 49.0 | 46.4 | 4.6 |
| D | 49.8 | 45.6 | 4.6 |
| E | 49.8 | 44.0 | 6.2 |
| F | 39.8 | 35.2 | 25.0 |

The lines AB and BC represent the upper limit of $M_s$ expected to allow the desired behavior, i.e. 20° C. The line AB corresponds approximately to a Ni:Ti atomic ratio of 1.13. The line CD corresponds to the lower limit of vanadium composition: alloys having less vanadium do not exhibit B- or C-type behavior in the desired temperature range even if of the correct $M_s$. The lines DE and EF represent the lower limit of $M_s$ giving the desired behavior, i.e. −40° C. The line EF corresponds approximately to an Ni:Ti atomic ratio of 1.02. Finally, the line FA represents the upper limit of vanadium content for the desirable SIM properties.

Presently preferred alloys include a region consisting essentially of 47.6–48.8% at % Ni, 45.2–46.4 at % Ti, remainder V around 48.0% Ni, 46.0% Ti, 6.0% V, which alloy has B-type behavior from 10° to 50° C.; and a region having an Ni:Ti atomic ratio between about 1.07 and 1.11 and a vanadium content between 5.25 and 15 atomic percent, which shows C-type behavior at 20° C. and/or 40° C.

In addition to the method described in the Example, alloys according to the invention may be manufactured from their components (or appropriate master alloys) by other methods suitable for dealing with high-titanium alloys. The details of these methods, and the precautions necessary to exclude oxygen and nitrogen either by melting in an inert atmosphere or in vacuum, are well known to those skilled in the art and are not repeated here.

Changes in composition cann occur during the electron-beam melting of alloys: the technique employed in this work. Such changes have been noted by Honma et al., Res. Inst. Min. Dress. Met. Report No. 622 (1972), and others. The composition ranges claimed as a part of this invention are defined by the initial commpositions of alloys prepared by the electron-beam method. However, the invention includes within its scope nickel/-titanium/vanadium alloys prepared by other techniques which have final compositions which are the same as the final compositions of alloys prepared here.

Alloys obtained by these methods and using the materials described will contain small quantities of other elements, including oxygen and nitrogen in total amounts from about 0.05 to 0.2 percent. The effect of these materials is generally to reduce the martensitic transformation temperature of the alloys.

The alloys of this invention are hot-workable and exhibit stress-induced martensite in the range of 0° to 60° C. in the fully annealed condition.

We claim:

1. A shape memory alloy consisting essentially of nickel, titanium, and vanadium within an area defined on a nickel, titanium, and vanadium ternary composition diagram by a hexagon with its first vertex at 38.0 atomic percent nickel, 37.0 atomic percent titanium, and 25.0 atomic percent vanadium; its second vertex at 47.6 atomic percent nickel, 46.4 atomic percent titanium, and 6.0 atomic percent vanadium; its third vertex at 49.0 atomic percent nickel, 46.4 atomic percent titanium, and 4.6 atomic percent vanadium; its fourth vertex at 49.8 atomic percent nickel, 45.6 atomic percent titanium, and 4.6 atomic percent vanadium; its fifth vertex at 49.8 atomic percent nickel, 44.0 atomic percent titanium, and 6.2 atomic percent vanadium; and its sixth vertex at 39.8 atomic percent nickel, 35.2 atomic percent titanium, and 25.0 atomic percent vanadium.

2. The alloy of claim 1 which has an Ni:Ti atomic ratio between 1.07 and 1.11 and a vanadium content between 5.25 and 15 atomic percent.

3. The alloy of claim 1 which consists essentially of between 47.6 and 48.8 atomic percent nickel, 45.2 and 46.4 atomic percent titanium, and the remainder vanadium.

4. A shape-memory article comprising a shape-memory alloy consisting essentially of nickel, titanium, and vanadium within an area defined on a nickel, titanium, and vanadium ternary composition diagram by a hexagon with its first vertex at 38.0 atomic percent nickel, 37.0 atomic percent titanium, and 25.0 atomic percent vanadium; its second vertex at 47.6 atomic percent nickel, 46.4 atomic percent titanium, and 6.0 atomic percent vanadium; its third vertex at 49.0 atomic percent nickel, 46.4 atomic percent titanium, and 4.6 atomic percent vanadium; its fourth vertex at 49.8 atomic percent nickel, 45.6 atomic percent titanium, and 4.6 atomic percent vanadium; its fifth vertex as 49.8 atomic percent nickel, 44.0 atomic percent titanium, and 6.2 atomic percent vanadium; and its sixth vertex at 39.8 atomic percent nickel, 35.2 atomic percent titanium, and 25.0 atomic percent vanadium.

5. The article according to claim 4 which has an Ni:Ti atomic ratio between 1.07 and 1.11 and a vanadium content between 5.25 and 15 atomic percent.

6. The article according to claim 4 which consists essentially of between 47.6 and 48.8 atomic percent nickel, 45.2 and 46.4 atomic percent titanium, and the remainder vanadium.

7. The article according to claim 4 exhibiting stress-induced martensite.

8. The article according to claim 4 exhibiting stress-induced martensite in the range of 0° to 60° C. when in the fully annealed condition.

* * * * *